US008840690B2

(12) United States Patent
Kar et al.

(10) Patent No.: US 8,840,690 B2
(45) Date of Patent: Sep. 23, 2014

(54) GASIFICATION REACTOR

(75) Inventors: Ibrahim Kar, Köln (DE); Manfred Heinrich Schmitz-Goeb, Gummersbach (DE)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 13/981,104

(22) PCT Filed: Jan. 23, 2012

(86) PCT No.: PCT/EP2012/050951

§ 371 (c)(1),
(2), (4) Date: Sep. 20, 2013

(87) PCT Pub. No.: WO2012/101081

PCT Pub. Date: Aug. 2, 2012

(65) Prior Publication Data

US 2014/0010713 A1 Jan. 9, 2014

(30) Foreign Application Priority Data

Jan. 25, 2011 (EP) ..... 11152040

(51) Int. Cl.
*C10J 3/68* (2006.01)

(52) U.S. Cl.
USPC ..... 48/76; 48/61; 48/69; 48/127.1; 48/127.9; 48/71; 48/72; 48/73; 48/200; 48/201; 48/202

(58) Field of Classification Search
USPC ..... 48/61, 127.9, 127.1, 76, 69, 71–73, 48/200–202
See application file for complete search history.

(56) References Cited

U.S. PATENT DOCUMENTS

| | | | | |
|---|---|---|---|---|
| 2,204,156 | A * | 6/1940 | Semon | 422/117 |
| 2,874,106 | A * | 2/1959 | Hammond et al. | 376/300 |
| 3,475,272 | A * | 10/1969 | Fortescue et al. | 376/174 |
| 3,708,994 | A * | 1/1973 | Crane | 62/48.4 |
| 3,902,515 | A * | 9/1975 | Douglas et al. | 137/68.22 |
| 4,305,732 | A * | 12/1981 | Koenig et al. | 48/67 |
| 4,406,747 | A * | 9/1983 | Velling | 202/227 |
| 4,893,912 | A | 1/1990 | Kohnen et al. | |
| 5,022,424 | A | 6/1991 | Reynolds et al. | |
| 5,230,717 | A * | 7/1993 | Ogawa et al. | 48/76 |
| 5,407,455 | A * | 4/1995 | Nilsson | 48/61 |
| 6,240,948 | B1 | 6/2001 | Hansen, III et al. | |
| 7,703,472 | B2 * | 4/2010 | Carolan et al. | 137/71 |
| 8,006,983 | B2 * | 8/2011 | Russell et al. | 277/314 |
| 8,136,544 | B2 * | 3/2012 | Wilson et al. | 137/240 |
| 2007/0119577 | A1 * | 5/2007 | Kraft et al. | 165/157 |
| 2008/0042373 | A1 | 2/2008 | Wilson et al. | |
| 2009/0029229 | A1 * | 1/2009 | Kanno | 429/34 |
| 2009/0119993 | A1 * | 5/2009 | Neves et al. | 48/197 R |
| 2011/0023362 | A1 * | 2/2011 | Kirchhubel et al. | 48/71 |

OTHER PUBLICATIONS

Basu, P.; "Design of Biomass Gasifiers"; Biomass Gasification and Pyrolysis; Chapter 6; pp. 167-228; Jun. 1, 2010.
Dirksen, H.A., et al.; "Balance-pressure pilot reactors"; Chemical Engineering Progress; American Institute of Chemical Engineers; vol. 62, No. 6; pp. 98-102; Jun. 1, 2006.

* cited by examiner

*Primary Examiner* — Kaity Handal

(57) ABSTRACT

A gasification reactor including a gasifier with a tubular gastight wall arranged within a pressure vessel. The tubular gastight wall is provided with one or more pressure relief passages sealed by a rupture element. The pressure relief passages can be provided with a cooled section, such as a double walled section confining a coolant channel.

9 Claims, 2 Drawing Sheets

GASIFICATION REACTOR

PRIORITY CLAIM

The present application claims priority from PCT/EP2012/050951, filed 23 Jan., 2012, which claims priority from European patent application 11152040.9, filed 25 Jan., 2011, which is incorporated herein by reference.

BACKGROUND OF THE INVENTION

The present invention relates to a gasification reactor comprising a gasifier with a tubular gastight wall arranged within a pressure vessel.

Gasification reactors can for instance be used for the production of synthetic gas by partial combustion of a carbonaceous feed, such as pulverized coal, oil, biomass, gas or any other type of carbonaceous feed.

Some gasification reactor types comprise a gasifier only having a discharge opening at its lower end for discharging syngas via a discharge—generally referred to as dip tube—into the slag collection bath. Due to the pressure build-up in the gasifier freshly produced synthetic gas containing slag and fly ash particles is forced to flow down through the dip tube and the slag collection bath around the lower edge of the dip tube to be recollected in the annular space between the dip tube and the pressure vessel wall. The water in the slag collection bath cleans and cools the synthetic gas.

During operation of the reactor, slag is continuously deposited on the inside of the gastight wall of the gasifier. Slag slides down from the inner surface of the gasifier wall and drops via the discharge opening into the slag collection bath. If the slag slides slowly the discharge opening in the gasifier is reduced by accumulation of slag lumps, which can eventually lead to blockage of the opening. This causes a build up of overpressure in the gasifier, which can cause substantial damage.

In other cases, an overpressure may develop in the annular space between the gasifier wall and the pressure vessel, for instance caused by a defect in the supply of water to the slag collection bath or by defective valves in the reactor's supply or discharge infrastructure.

SUMMARY OF THE INVENTION

It is an object of the invention to prevent damage of a gasification reactor caused by overpressure within the gasifier and/or overpressure in the space between the gasifier and the pressure vessel.

The object of the invention is achieved with a gasification reactor comprising a gasifier with a tubular gastight wall arranged within a pressure vessel, wherein the tubular gastight wall is provided with one or more passages sealed by a rupture element.

Accordingly, if the differential pressure over the gasifier wall exceeds a certain limit value, the one or more rupture elements will break and pressure within the gasifier is equalized with the pressure between the gasifier wall and the pressure vessel.

Suitable rupture elements include rupture discs, or bursting discs or diaphragms, blowout panels, blow-off panels and rupture panels or vent panels, which may be circular, square or rectangular or have any desired shape. Such discs or panels can for instance be constructed from carbon steel, stainless steel, graphite and nickel alloys of molybdenum, chromium, cobalt, iron, copper, manganese, titanium, zirconium, aluminum, carbon, and/or tungsten, such as Hastelloy® alloys of Haynes International, Inc., or any other suitable materials.

The one or more passages in the gasifier wall may for instance be provided with a sleeve with a cooled section extending outwardly from an opening in the gasifier wall. The cooled sleeve forms a heat sluice and creates an area with the same pressure as within the gasifier, but with substantially lower temperatures. This protects the rupture element from premature failure due to thermal loads.

To protect the gasifier wall against the high temperatures within the gasifier, the wall is generally cooled. To this end the gastight wall can for instance wholly or partly be built from interconnected parallel tubular coolant lines. In that case these tubular lines can be by-passed around the one or more openings.

Optionally, the sleeve can be provided with a refractory lining surrounding the sleeve's end around the opening. In that case, one or more sections of the tubular lines by-passing one of the openings can be embedded in the refractory lining around the sleeve section.

In order to be able to keep the space enclosed by the sleeve clean and open, the sleeve can for example be connected to a source of purging gas, e.g., by means of one or more nozzles directed towards the opening surrounded by the sleeve. The purging gas can be any inert gas, such as nitrogen, steam or clean product gas.

Optionally, the passages can branch into a first branch sealed by a first rupture element dimensioned to break at an overpressure limit in the gasifier, and a second branch sealed by a second rupture element dimensioned to break at an overpressure limit in a space between the gasifier and the pressure vessel wall. The rupture elements can be dimensioned to break at the desired pressure by dimensioning the thickness, concavity or convexity and by material selection.

To reduce the risk of damage by fly ash particles, the pressure relief passages can for instance be positioned at the top end of the gasifier, where the fly ash content is lowest.

An exemplary embodiment of the invention will now be described by reference to the accompanying drawing, in which:

BRIEF DESCRIPTION OF THE DRAWINGS

FIG. 1 shows a schematic cross section of an exemplary embodiment of a gasification reactor 1 according to the present invention. The gasification reactor 1 comprises a gasifier 2 in a tubular gastight wall 3 with a closed top end 4 and a conical lower section 5 narrowing down to an open lower end 6 which opens into a coaxially arranged cylindrical duct or dip tube 7. The duct 7 opens into a slag collection bath 8 filled with water.

DESCRIPTION OF THE PREFERRED EMBODIMENT

Figure 1:
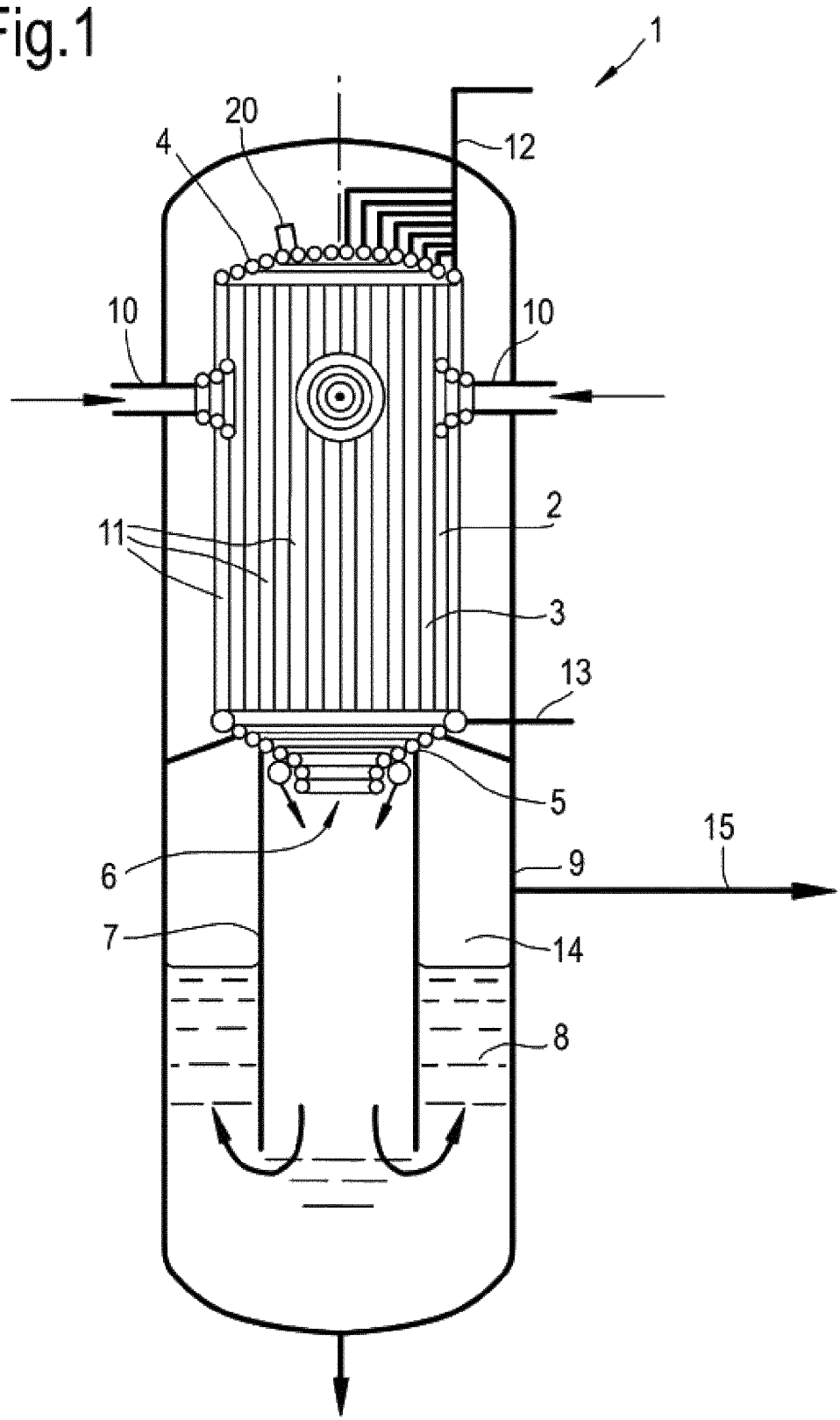
FIG. 1: shows schematically a longitudinal cross section of an embodiment of a gasification reactor according to the present invention.

The gasifier 2 is arranged coaxially within a closed cylindrical pressure vessel 9. Burners 10 extend from outside through the wall of the pressure vessel 9 and the tubular wall 3 into the gasifier 2 to partially combust pulverized coal or other types of carbonaceous feed.

The tubular wall 3, its closed top end 4 and its conical lower end 5 are built from a plurality of parallel tubular lines 11. The lines 11 are operatively connected to a coolant supply 13 and lead to a coolant discharge 12.

During operation the gasifier content is heated to a temperature of 1200-1700° C. At these temperatures the carbonaceous feed is partially combusted to form synthetic gas loaded with slag and fly ash. Due to the pressure built-up in the gasifier 2 the gasifier content is forced to flow downwardly via the opening 6 and the duct 7 into the water of the slag collection bath 8. The water of the slag collection bath 8 filters the syngas to remove fly ash and slag. The filtered syngas surfaces in the annular space 14 between the duct 7 and the pressure vessel 9, where the pressure is substantially lower than in the gasifier 2 and the duct 7. Here, the syngas is discharged via a discharge line 15.

Figure 2:
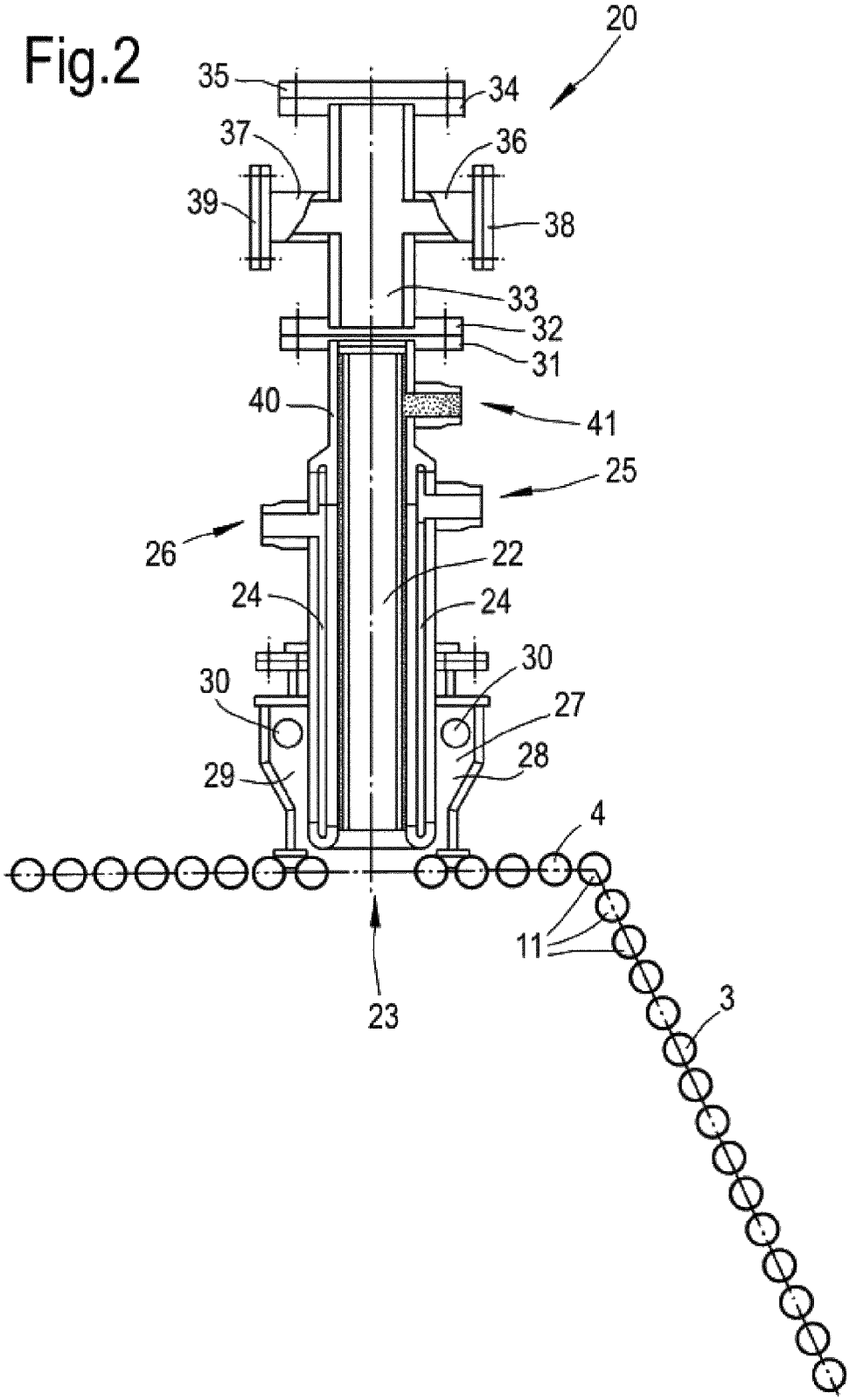
FIG. 2: shows in detailed cross section a pressure relief passage in the gasification reactor of FIG. 1.

At its top end 4 the gastight wall 3 of the gasifier 2 comprises one or more pressure relief passages 20, which are shown in more detail in FIG. 2. The pressure relief passage 20 comprises a hollow cylindrical double-walled sleeve 22 extending outwardly from the top end 4 of the tubular wall 3. The sleeve 22 is connected to an opening 23 in the tubular wall assembly 3. The sleeve 22 is double-walled to define an annular cylindrical coolant channel 24 between its double walls. The annular coolant channel 24 comprises a coolant inlet 25 and a coolant outlet 26, operatively connected to a coolant supply and a coolant discharge, respectively (not shown). The coolant is usually water.

At the opening 23 the sleeve 22 is surrounded by a refractory box 27 comprising a metal casing 28 filled with a refractory material 29. The refractory material 29 embeds by-pass sections 30 for by-passing the lines 11 of the tubular wall section 3 around the opening 23.

At its end opposite to the opening 23 the double walled sleeve 22 is provided with a flange 31 connected to a lower flange 32 of a cylinder 33. At its opposite end, the cylinder 33 comprises a top flange 34 connected in a gastight manner to a lid 35. Optionally, the lid 35 can be provided with a passage for a connecting line for a pressure measurement device, enabling measurement of the pressure within the gasifier in the cooled environment of the double walled sleeve 22. The cylinder 33 further comprises a first branch 36 and a second branch 37 branching off laterally under right angles in opposite directions. The outer end of the first branch 36 is sealed by a first rupture disc 38, which is shaped and dimensioned to rupture if the differential pressure at both sides of the rupture disc 38 exceeds a given upper limit caused by an overpressure in the gasifier 2. The outer end of the second branch 37 is sealed by a second rupture disc 39, which is shaped and dimensioned to rupture if the differential pressure at both sides of the rupture disc 39 exceeds a given upper limit caused by an overpressure in the annular space between the gasifier 2 and the pressure vessel 9.

Between the double walled section and the flange 31 the pressure relief passage 20 comprises a single walled cylindrical section 40 with a connection 41 for a feed line of a purging gas (not shown). The purging gas can be used to blow the inner side of the pressure relief passage 20 and the opening 23 clean and to keep it clean of fly ash deposits.

The cooled section of the pressure relief passage 20 thermally shields the rupture discs 38, 39 from the gasifier content, which can be as hot as 1200° C. or higher. The pressure relief passage 20 forms a heat sluice which can for instance also be used for measuring the pressure in the gasifier in a cooled environment.

What is claimed is:

1. A gasification reactor comprising a gasifier with a tubular gastight wall arranged within a pressure vessel, wherein the tubular gastight wall is provided with one or more pressure relief passages sealed by a rupture element that is in fluid communication with the annular space between the gasifier gastight wall and the pressure vessel, wherein the one or more pressure relief passages comprise a sleeve with a cooled section extending outwardly from an opening in the gasifier wall and wherein the cooled section of the sleeve is provided with a double wall enclosing an annular coolant channel.

2. A gasification reactor according to claim 1 wherein the rupture element is a rupture disc.

3. A gasification reactor according to claim 1 wherein the cooled section of the sleeve is operatively connected to a pressure measurement device at the exterior of the pressure vessel via a measurement line.

4. A gasification reactor according to claim 1 wherein the gastight wall is at least partly built from interconnected parallel tubular lines, and wherein the tubular lines are by-passed around the at least one of the one or more openings at the exterior side of the gasifier.

5. A gasification reactor according to claim 4 wherein one or more sections of the tubular lines by-passing one of the openings are embedded in the refractory lining around the sleeve section.

6. A gasification reactor according to claim 1 wherein a refractory lining surrounds the cooled section of the sleeve around the opening.

7. A gasification reactor according to claim 1 wherein the sleeve comprises a purging gas inlet.

8. A gasification reactor according claim 1 wherein one or more of the pressure relief passages branches into a first branch sealed by a first rupture element shaped and dimensioned to break at an overpressure limit in the gasifier, and a second branch sealed by a second rupture element shaped and dimensioned to break at an overpressure limit in a space between the gasifier and the pressure vessel wall.

9. A gasification reactor according to claim 1 wherein at least one of the one or more pressure relief passages is positioned at the top end of the gasifier.

* * * * *